United States Patent [19]

Litchfield et al.

[11] 4,162,114

[45] Jul. 24, 1979

[54] DRAWERS AND DRAWER COMPONENTS

[75] Inventors: Leon G. Litchfield; Terence Hardy, both of Belper, England

[73] Assignee: L. B. (Plastics) Limited, Derbyshire, England

[21] Appl. No.: 816,039

[22] Filed: Jul. 15, 1977

[30] Foreign Application Priority Data

Apr. 26, 1977 [GB] United Kingdom ..... 17290/77

[51] Int. Cl.[2] ..... A47B 88/04; A47B 88/14

[52] U.S. Cl. ..... 312/330 R; 308/3.8; 308/6 R; 312/346; 312/350

[58] Field of Search ..... 312/330 R, 334, 346, 312/349, 347, 350, 330 SM; 308/3.6, 3.8, 6 R

[56] References Cited

U.S. PATENT DOCUMENTS

| | | | |
|---|---|---|---|
| 3,315,834 | 4/1967 | Nemlich | 220/62 |
| 3,456,996 | 7/1969 | Heiniger-Schar | 312/330 |
| 3,528,718 | 4/1970 | Johnson et al. | 312/330 |
| 3,556,626 | 1/1971 | Schock | 312/330 |
| 3,687,512 | 8/1972 | Alston | 312/330 |
| 3,901,572 | 8/1975 | Litchfield | 312/330 |
| 3,973,814 | 8/1976 | Entrikin | 312/330 R |

FOREIGN PATENT DOCUMENTS

| | | | |
|---|---|---|---|
| 1341399 | 12/1973 | United Kingdom | 312/330 |
| 1358047 | 6/1974 | United Kingdom | 312/330 |

*Primary Examiner*—Mervin Stein
*Assistant Examiner*—Alex Grosz
*Attorney, Agent, or Firm*—Marshall & Yeasting

[57] ABSTRACT

A drawer side panel having a channel extending lengthwise of the face thereof which is outermost in use, the channel being parallel to one longitudinal edge of the panel and having a longitudinally extending lip projecting across the entrance to the channel from at least one longitudinal edge thereof. The panel is used with novel forms of drawer runner and may be adapted to be interchangeably mounted on runners of different construction. Various other novel components are also disclosed.

21 Claims, 26 Drawing Figures

5B
6A
6B
6B
6C
22
20
21
23

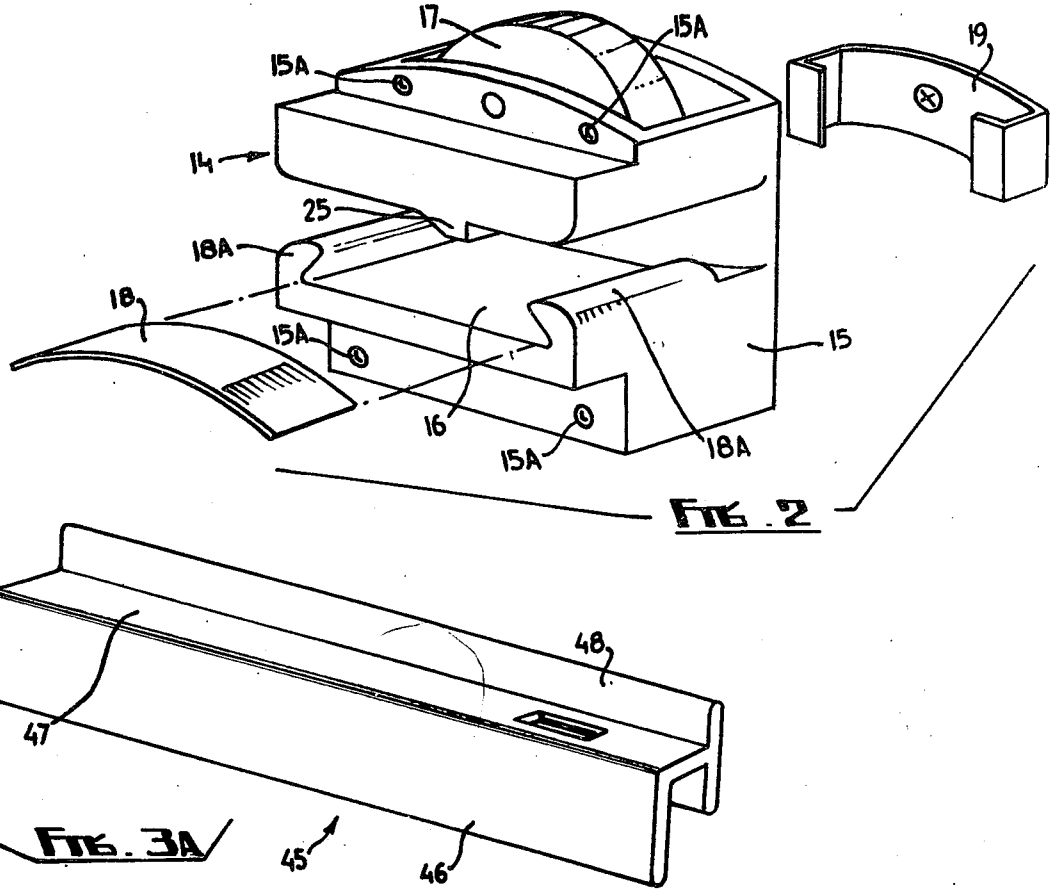
FIG. 2
FIG. 3A
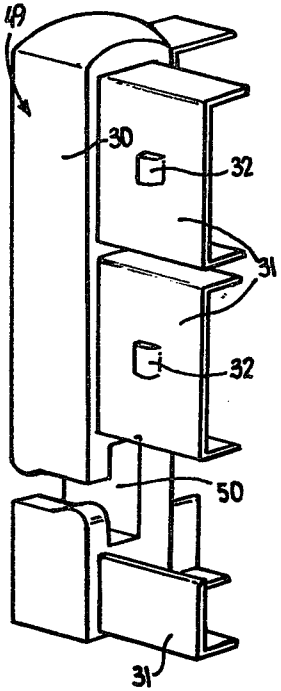
FIG. 3B
FIG. 3

105
114
110
120
106
135

105
110
106
150
145

141
142
140
141A
141
141A
142
141
104

114
115
118
115A
117
115A
118A
125
116
118A 142
140A
141
141
141A
140
142
141
104

160
161

DRAWERS AND DRAWER COMPONENTS

The invention relates to drawers and to parts and components thereof. The invention is particularly concerned with so called "knock-down" drawers of plastic construction comprising hollow extruded wall panels having slots therein for accommodation of the drawer floor and adapted to be interconnected at right angles to one another by corner pieces having projecting spigots engageable in the ends of the wall panels. The invention is however also applicable to other forms of drawer.

Drawers are conventionally mounted either on fixed runners or on roller runners. The former provide a simple means of mounting drawers in cabinets or the like but suffer from the disadvantage that relatively high friction forces are present between the drawer and the runners and drawers mounted in this way are not generally suitable for carrying heavy loads. Roller runner assemblies, though more complicated, eliminate or reduce friction between the drawer and its runners, thereby enabling greater loads to be carried.

A disadvantage of roller runner assemblies is that separate guide or runner members require to be mounted both in the supporting cabinet and on the drawer itself in order to accommodate the roller assembly between them and the extent to which such runner assemblies project from the opposite sides of the drawer reduces the overall width of drawer which can be accommodated in a cabinet having an opening of a predetermined size. Additionally the working parts of the roller assembly itself are liable to become fouled by dirt and other foreign matter which can cause malfunctioning.

It is an object of the present invention to obviate or mitigate these disadvantages.

According to one aspect of the invention there is provided a drawer side panel having a channel extending lengthwise of the face thereof which is outermost in use, the channel being parallel to one longitudinally extending lip projecting across the entrance to the channel from at least one longitudinal edge thereof.

Preferably upper and lower longitudinally extending lips project across the entrance to the channel from the opposite longitudinal edges thereof.

Preferably also the channel is inset into the panel, the or each lip being flush with the outer face of the panel itself.

Preferably also a slot is formed in the face of the panel opposite to that in which said channel is formed, the slot being adapted in use to receive an edge of a drawer bottom.

The panel is preferably provided with means enabling its attachment to adjacent wall panels. In the case of hollow extruded plastics panels attachment to adjacent wall panels may be effected by means of connecting pieces having projections adapted for engagement in the hollow ends of the panel.

The invention also provides a drawer assembly having opposed side walls each incorporating an integral track or channel extending lengthwise thereof parallel to one longitudinal edge, a longitudinal lip projecting across the mouth of said channel from at least one longitudinal edge thereof so as to define a relatively narrow inlet opening to said channel, and a drawer guide and bearing member located within the channel and retained therein by said lip the guide and bearing member being adapted for locking engagement with a runner member adpated to be mounted in a cabinet in which the drawer is to be mounted in use so as to project into said track through the inlet opening thereof.

The back and sides of the drawer may be interconnected by corner pieces having openings therein which slidably receive the respective runners whereby to guide and support the rear end of the drawer during opening and closing movements thereof.

Thus the invention also provides a drawer assembly comprising a drawer having integral tracks formed in the sides thereof, a pair of drawer runners adapted for engagement with said tracks and dimensioned so as to leave a clearance above and below same when located in the tracks, a front guide and bearing member interposed between each runner and the associated track at the forward end of the runner and a rear guide and bearing member incorporated in each rear corner of the drawer to guide and support the rear end of the drawer on the respective runner.

Preferably the tracks or channels in the drawer sides are adapted to receive any of a number of interchangeable drawer runners of different form. Thus the invention also provides a drawer assembly comprising a drawer having tracks formed in the sides thereof adapted to receive any one of a plurality of interchangeable drawer runners of different form and a plurality of alternatively useable guide and bearing members adapted to slidingly support and guide the rear end of the drawer on the respective forms of runner. The guide and bearing members may be adapted to be removably mounted at the rear of each of said tracks.

The invention also embraces novel drawer runners which may be used in association with drawers constructed as aforesaid. Thus the invention also provides a drawer runner comprising an elongated member of angle section having a mounting flange by means of which the runner may be mounted at a suitable location in a drawer cabinet or like supporting structure and a drawer-engaging flange projecting at right angles to the mounting flange and adapted to extend into a track or channel formed in a drawer side, the drawer-engaging flange being provided with or being adapted to engage with means for slidably supporting the drawer in the cabinet or like structure.

The invention also provides a drawer runner comprising an elongated member of angle section having a mounting flange by means of which the runner may be mounted at a suitable location in a drawer cabinet or like supporting structure and a drawer engaging flange projecting at right angles to the mounting flange and adapted to extend into a track or channel former in a drawer side, said mounting flange extending beyond said drawer engaging flange at one end and the extended portion rotatably supporting at least one roller having its axis aligned with said drawer-engaging flange.

The invention also provides a drawer runner comprising an elongated member of angle section and L shaped cross-section having a mounting flange by means of which the runner may be mounted at a suitable location in a drawer cabinet or like supporting structure and a drawer engaging flange projecting at right angles to the mounting flange, one of said flanges supporting or being adapted to support a bearing member for a drawer and the runner being constructed so that it may be used with said drawer engaging flange above or below said mounting flange.

In addition the invention provides an article of furniture comprising a cabinet or housing and a drawer supported in the cabinet or housing by means of runners having portions thereof extending into and retained against lateral withdrawal from tracks in the drawer sides. Preferably front guide and bearing members are mounted at the forward ends of said portions of the runners to slidably support and guide the drawer thereon. Alternatively said portions of the runners may be provided with projecting bearing surfaces on which the drawer is slidably supported.

The invention also provides a drawer having a back and sides formed from extruded hollow plastics panels each having a recess in one face thereof for engagement with a drawer runner and a recess in the opposite face thereof adapted to receive an edge of a drawer bottom, and internal webs extending across the panel at intervals to strengthen same, the panels being interconnected by connecting members each comprising a corner post and spigots projecting therefrom in two directions at right angles for engagement in the ends of the panels, interference projections being positioned at appropriate locations on said corner piece and/or one or more of said spigots to interfere with one or more of said internal webs and prevent complete engagement of the parts in the event of the corner pieces being incorrectly presented to the panels during assembly.

Embodiments of the invention will now be described, by way of example only, with reference to the accompanying drawings in which:

FIG. 2 is an enlarged perspective view of the guide and bearing member shown in FIG. 1B;

FIG. 3 is a perspective view of a modified construction comprising a modified drawer runner shown in FIG. 3A and a modified corner construction shown in FIG. 3B;

Figure 1:
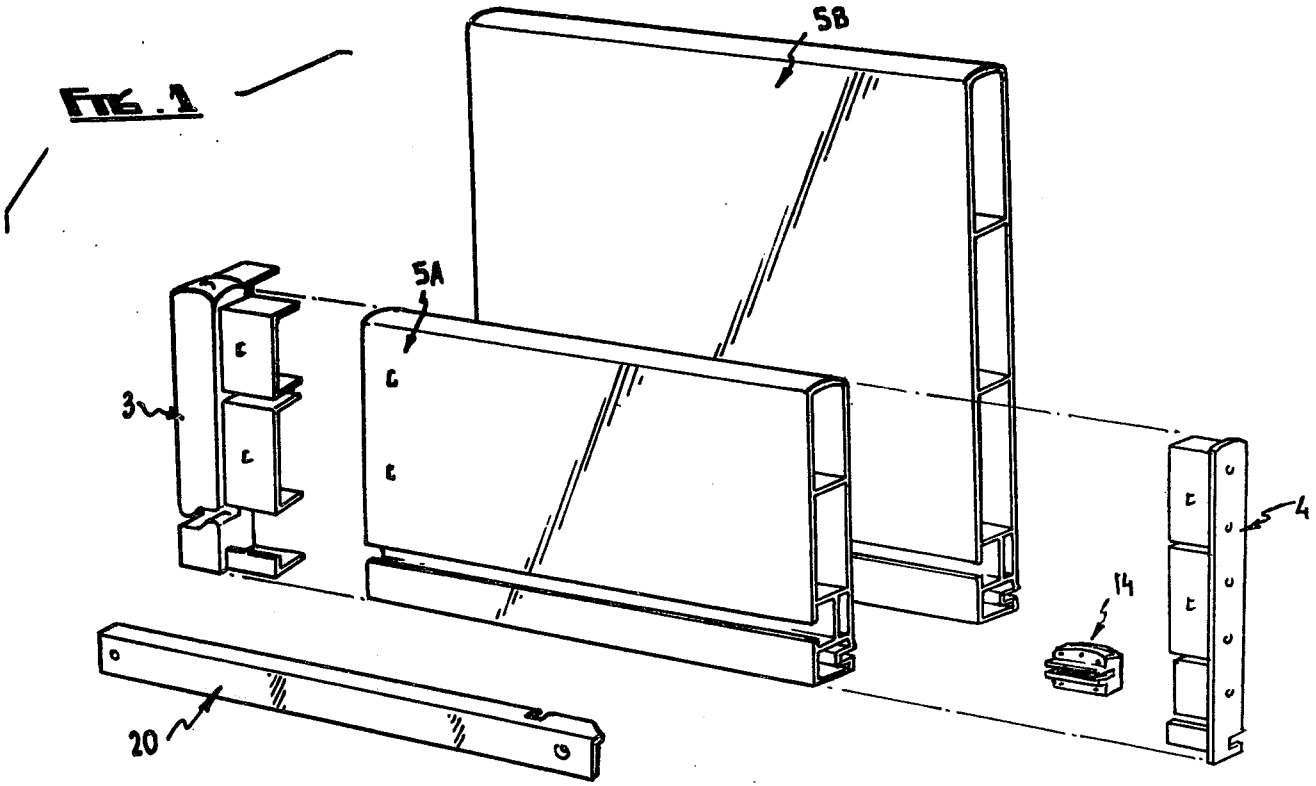
FIG. 1 is an exploded perspective view showing part of one form of drawer and runner construction incorporating features of the invention and comprises FIGS. 1A to 1G.

The drawer constructions shown in the drawings are of so called "knock-down" construction, the sides and back comprising identical extruded hollow panels interconnected at right angles to one another by corner pieces. The forward ends of the side panels are connected to the drawer front by means of end connectors, and inwardly directed slots are provided adjacent the lower edges of the panels to receive the edges of a drawer bottom.

Figure 1A:
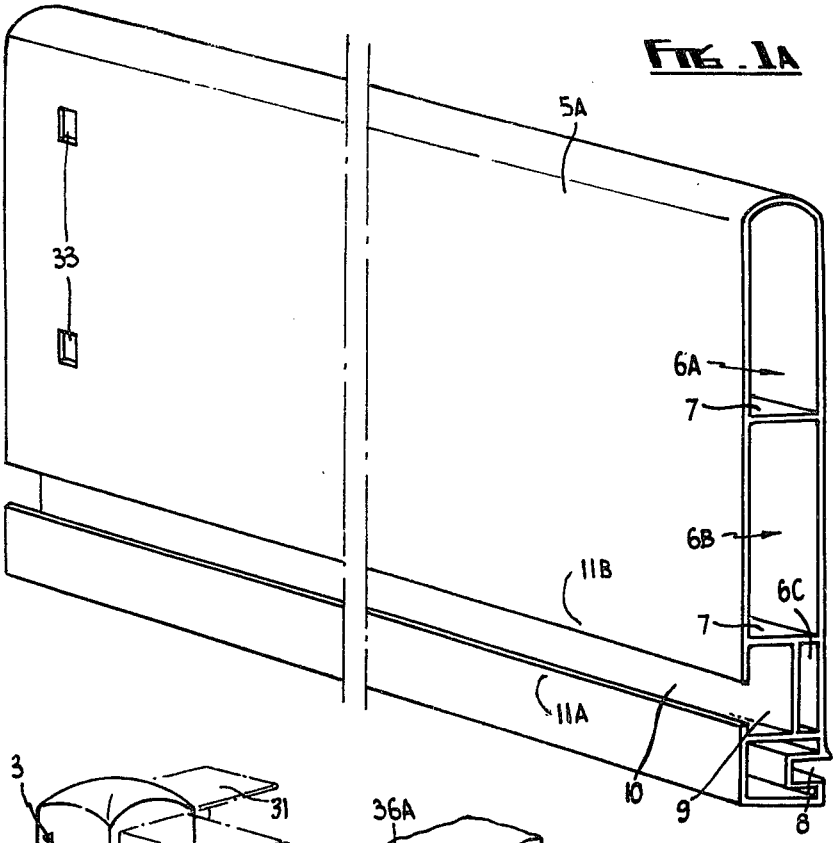
FIG. 1A is a perspective view of a drawer side panel.
Figure 1D:
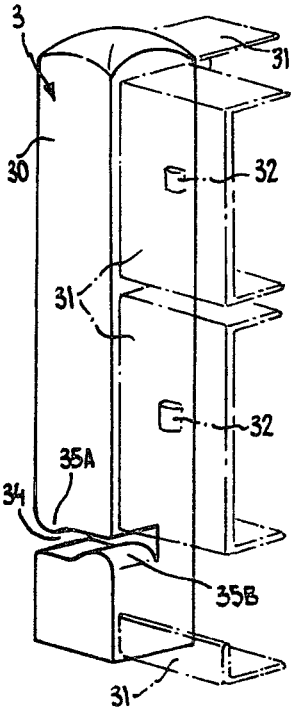
FIG. 1D is a perspective view of a corner connector used in connecting the drawer back and side panels.
Figure 1E:
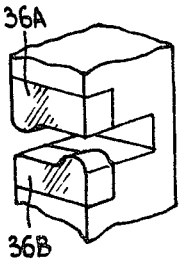
FIG. 1E is a scrap view showing a modification of the corner connector shown in FIG. 1D.
Figure 1B:
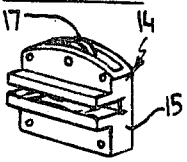
FIG. 1B is a perspective view of a guide and bearing member adapted for sliding engagement in a track formed in the drawer panel shown in FIG. 1A.
Figure 1F:
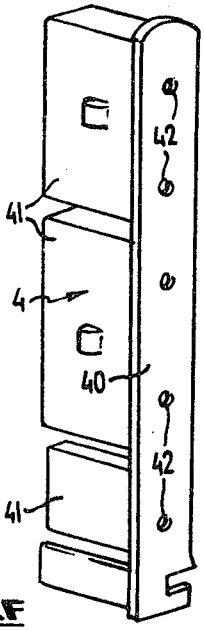
FIG. 1F is a perspective view of a front connector for use in connecting the side panel to the drawer front.
Figures 1C, 1G:
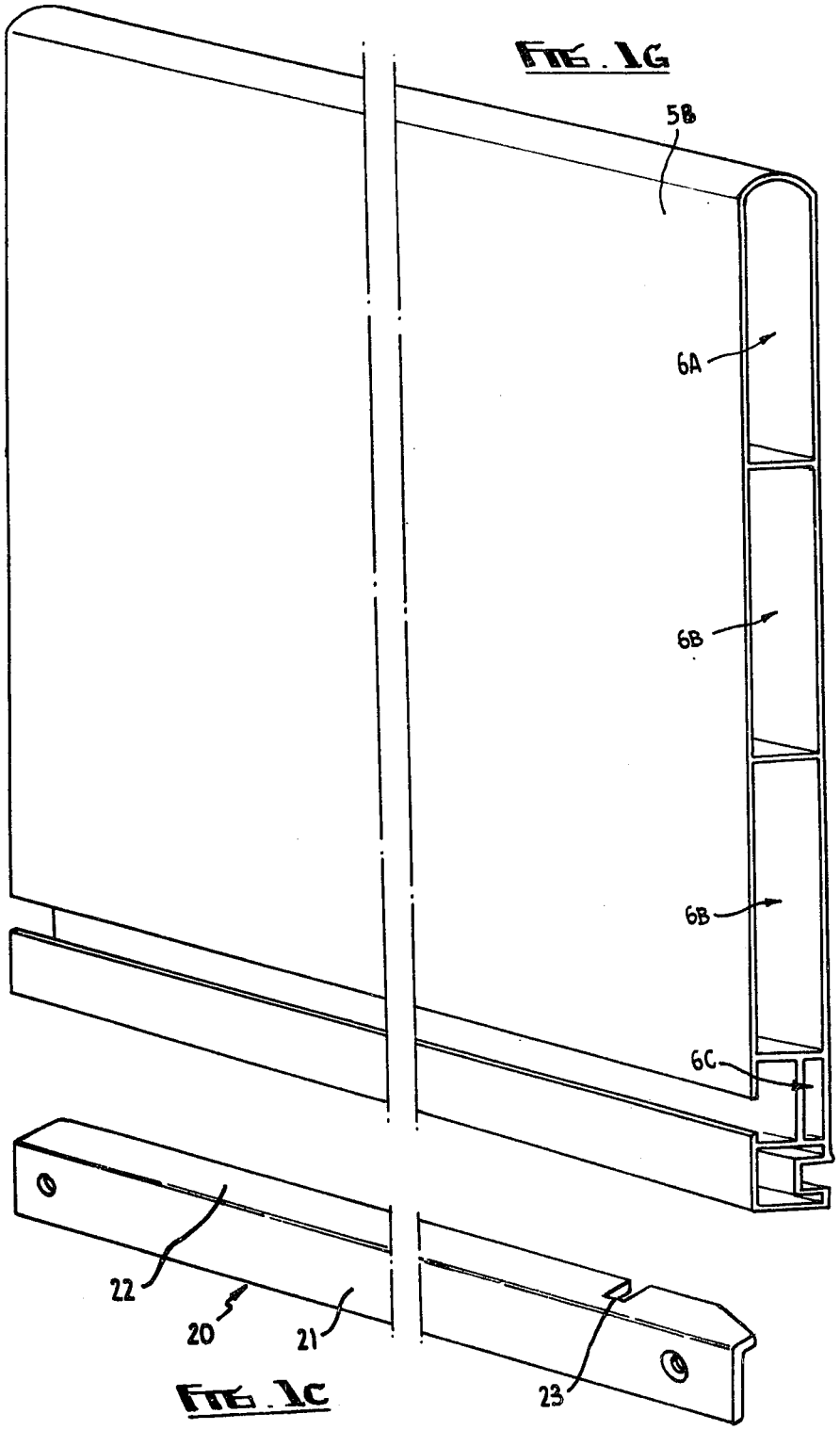
FIG. 1C is a perspective view of a drawer runner.
FIG. 1G is a perspective view of drawer side panel of larger size than that shown in FIG. 1A.

FIGS. 1A and 1G show two alternative sizes of side panel 5A and 5B, both of extruded plastics construction and of hollow section. The corner pieces 3 by means of which the side and back panels are interconnected are shown in FIGS 1D and the end connectors 4 serving to connect the drawer sides to a suitable facia panel are shown in FIG. 1F.

The drawer panel 5A shown in FIG. 1A comprises upper, intermediate and lower hollow sections 6A, 6B and 6C separated by internal webs 7. The larger side panel 5B shown in FIG. 1G incorporates an additional intermediate section 6B but is otherwise of similar construction. An inwardly directed recess 8 is formed adjacent the lower longitudinal edge of the panel to accommodate an edge of a drawer bottom (not shown). The lower hollow section 6C of the panel incorporates a longitudinal channel 9 the entrance to which comprises a narrow slot 10 defined between upper and lower longitudinal lips 11A, 11B extending across the channel 9 towards one another so as to partially enclose same. The channel 9 constitutes an integral runner track designed to accommodate a guide and bearing assembly member 14 (FIG. 1B).

The guide and bearing member is shown in greater detail in FIG. 2 and comprises a body portion or carriage 15 formed with a through track or slot 16 and surmounted by a rotatable roller 17. A curved leaf spring 18 is located in the bottom of the track 16 between inturned lips 18A, and a further curved leaf spring 19 engages with the portion of the body 15 defining the back or inner wall of the recess 16 so as to project therefrom in the opposite direction from the recess. Pips 15A project from the faces of the body portion which engage the lips 11A, 11B of the track 9 to reduce frictional contact. Similar pips (not shown) are provided on the underside of the body portion.

In use the guide and bearing member is located in the track 9 with the roller 17 uppermost and the recess or slot 16 in alignment with the narrow entrance 10 to the track 9. The member is retained in the track by the lips 11A, 11B and by the corner piece 3 and front connector 4 which are located in the ends of the drawer panel when the drawer is assembled.

The guide and bearing member is adapted for engagement with a fixed drawer runner 20 (FIG. 1C) of angle form and L-shaped cross-section having a mounting flange 21 by means of which the runner may be mounted in a suitable position in a cabinet or like housing in which the drawer is to be slidably located, and a drawer-engaging flange 22 which projects at right angles from the securing flange and is adapted to extend into the channel 9 for locking engagement with the guide and bearing member. For this purpose a notch 23 is formed adjacent the forward end of the drawer-engaging flange 22 and is adapted to engage with the guide and bering member to retain same in a fixed position on the runner 20. A downwardly directed projection 25 is formed on the upper surface of the slot 16 in the guide and bearing member and engages with the notch 23 in the runner 20, engagement being maintained by virtue of the spring 18 urging the guide and bearing member downwardly and thereby retaining the projection 25 in the notch.

The spring 19 serves to urge the guide and bearing member bodily away from the back or inner wall of the track 9 and accommodates for differences in tolerance of the drawer components introduced during manufacture by allowing the guide and bearing member to adopt different positions in the track 9 dependent on the extent to which the runner flange 22 extends into the track.

The corner pieces 3 (FIG. 1D) each comprise an upstanding corner post 30 having spigot members 31 projecting therefrom at right angles and spaced and dimensioned so as to form a tight push fit in the upper, intermediate and lower cavities of the associated wall panels. Detents 32 are provided on the two uppermost projections 31 and engage in holes 33 formed in the outer face of the wall panel adjacent to the end thereof. Towards its lower end the post 30 is provided with a through slot 34 for accommodation of the flange 22 of the runner 20. Opposed curved bearing surfaces 35A, 35B are formed at the recess 34 to facilitate sliding movement and reduce wear. If desired these bearing surfaces may be replaced by separate inserts 36A, 36B of wear-resistant material as shown in FIG. 1E. Alternatively a roller or rollers could be incorporated. The slot 34 thus provides a guide and bearing member for supporting the rear end of the drawer during sliding movement.

The front connecting member 4 (FIG. 1F) comprises a face plate 40 provided with spigot members 41 similar to the spigots or projections 31 formed on the corner connectors 3 and adapted for engagement in the hollow ends of the associated side wall panel. Prior to insertion of the front connectors into the wall panel they are secured to a suitable facia panel by screws passed through holes 42 in the face plate 40, whereupon the assembly comprising the facia panel and the two front connectors is engaged with the open forward ends of the side panels, the drawer bottom having been inserted in the meantime.

In use, the drawer is supplied to the customer in disassembled condition and is erected by inserting the corner pieces 3 in the open ends of the side and back panels thereby joining same together at right angles to one another. Thereafter the guide and bearing member 14 may be inserted in the tracks 9 in the side walls and the drawer bottom engaged in the slots 8. The front connectors 4 are then secured to the facia panel is suitable positions corresponding to the spacing of the drawer sides and the assembly comprising the facia panel and the front connectors is then engaged with the remainder of the drawer by pushing the front connectors into the hollow ends of the side wall panels. The guide and bearing members are then trapped within the tracks 9 at opposite sides of the drawer but are free to slide longitudinally thereof.

The drawer may then be inserted in the cabinet or the like in which it is to be housed and which is first of all provided with opposed runners of the kind shown in FIG. 1C. The drawer may be engaged with the runners by simply pushing it into the opening in the cabinet to its fully closed position in which the projections 25 on the guide and bearing members reach the notches 23 in the respective runners. The guide and bearing members then lock on to the associated runners and are retained in position, the drawer being free to slide along the runners between the limits defined by engagement of the guide and bearing members with the corner pieces and front mouldings which are disposed at opposite ends of the tracks 9. If it is desired to release the drawer from the cabinet the springs 18 are depressed by lifting the front of the drawer, thereby allowing the guide and bearing members to be disengaged from the slots 23 whereupon the drawer can be drawn completely out of the cabinet.

It will be appreciated that the arrangement described provides a drawer construction at least partially mounted on roller runner assemblies which is of simple and compact construction. By virtue of the provision of the channels or tracks within the dimensions of the side panels themselves, the overall width of the drawer which can be accommodated in an opening of a given size is increased compared with similar drawers utilising conventional roller runner assemblies. The moving parts are also wholly enclosed within the drawer panels themselves and thereby protected from damage.

FIG. 3 shows a modification enabling the drawer to be used with a fixed runner system. For this purpose the runner 20 shown in FIG. 1C is replaced by an alternative runner 45 shown in FIG. 3A having a vertical or mounting flange 46 enabling the runner to be attached to a drawer cabinet or the like in a suitable position, and a horizontal or drawer-engaging flange 47 which, in use, extends into the track 9 through the narrow entrance slot 10. The runner also incorporates a supporting and guiding flange 48 extending at right angles to the flange 47 and providing an upwardly directed bearing surface on which the drawer runs. In use the flange 48 is trapped within the track 9 in the drawer side thereby retaining the drawer against lateral movement and providing a bearing surface on which the drawer may run.

A modified form of corner connector 49 (FIG. 3B) is utilised in association with the runner 45. This connector is generally similar to that shown at 3 in FIG. 1D but incorporates a generally T-shaped recess 50 to accommodate the flange 48 as the drawer slides along the runner. In other respects the corner piece is constructed and functions in the same manner as that described with reference in FIG. 1D.

The drawer assembly may thus be utilised in association with either fixed or roller runners without requiring any modification of the drawer itself other than the substitution of the modified form of corner connector. In practice the connector shown in FIG. 3B will normally be utilised so that the drawer may be used with fixed or roller runners without modification. Alternatively different forms of insert of the kind shown in FIG. 1E could be provided to enable conversion from one form to the other.

Figure 4:
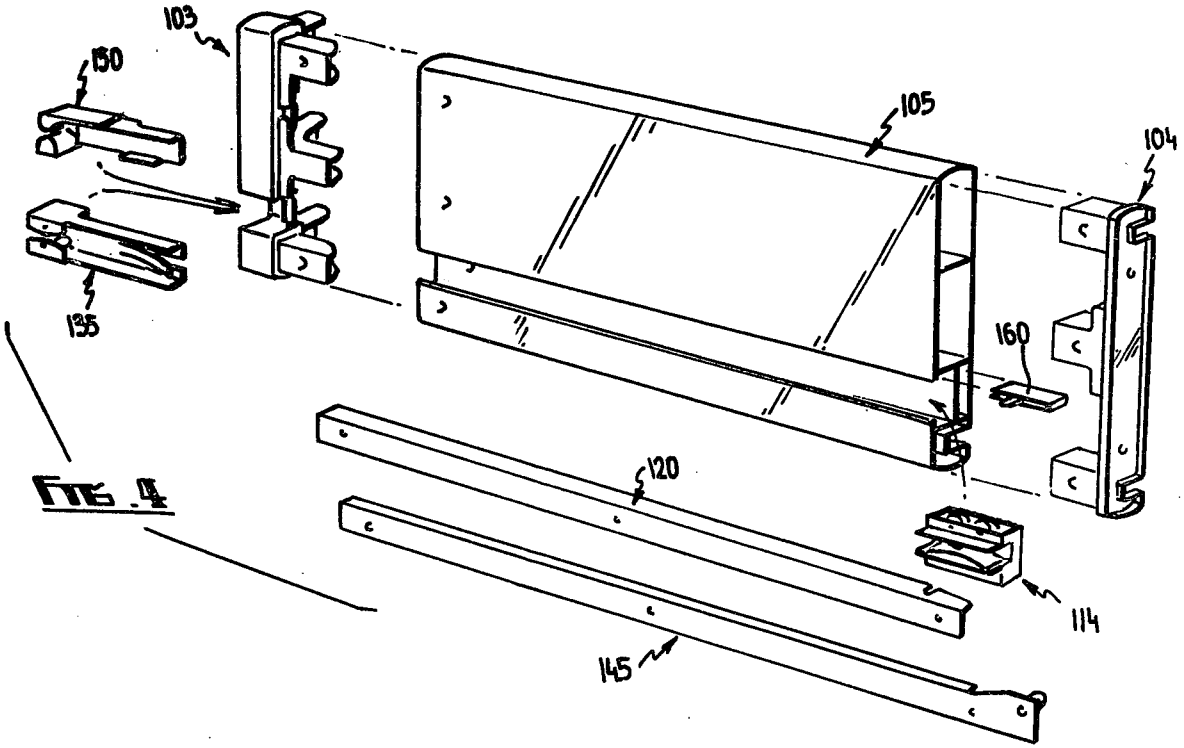
FIG. 4 is an exploded perspective view of modified forms of drawer and runner construction incorporating features of the invention and comprises FIGS. 4A to 4L.
Figure 4A:
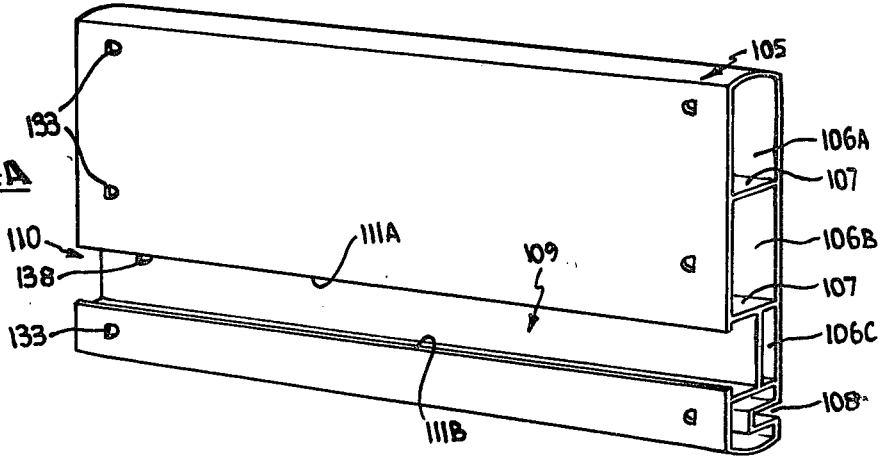
FIG. 4A is a perspective view of a drawer side panel.
Figures 4B, 4G, 4H, 4J, 5, 6:
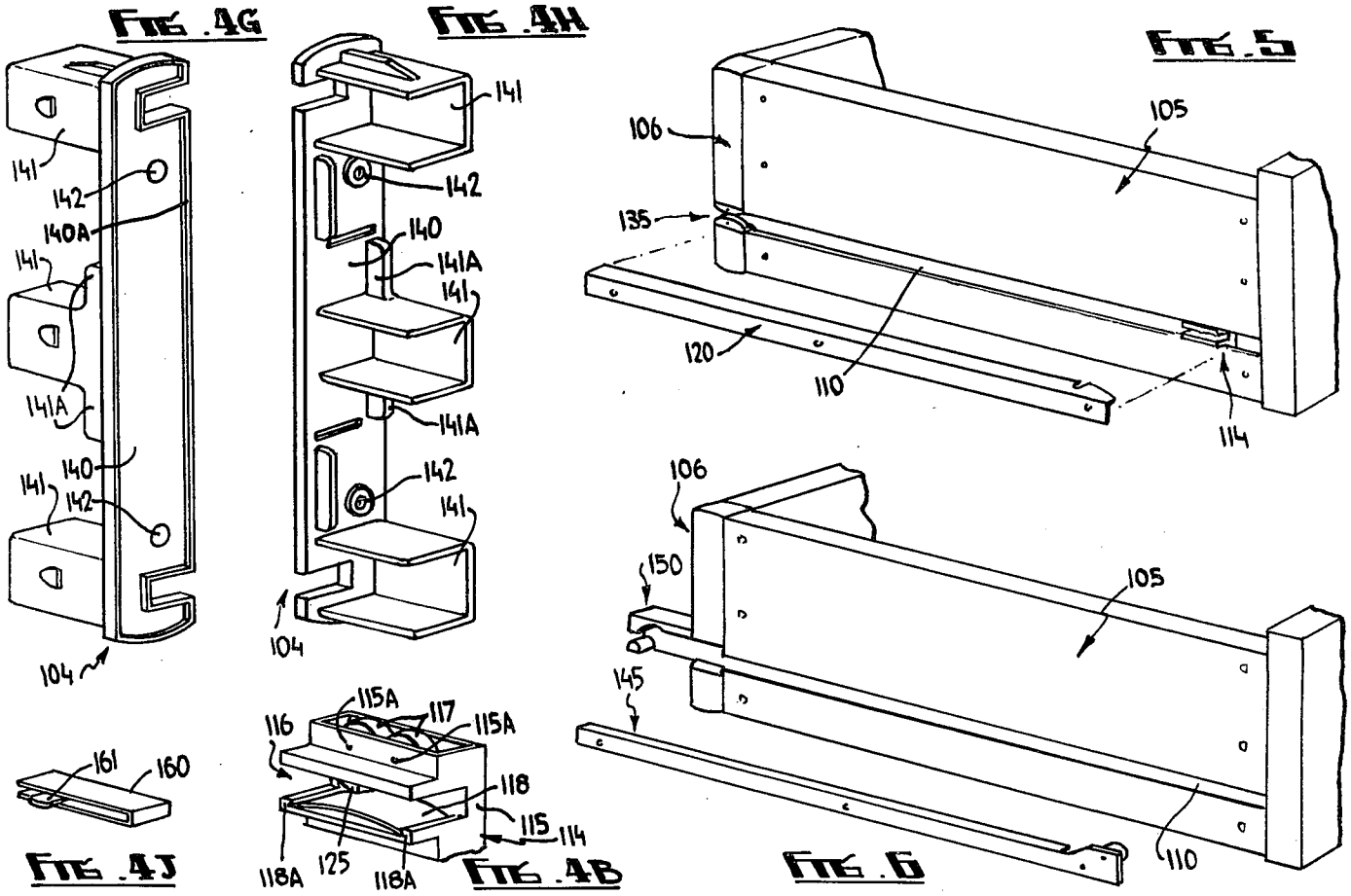
FIG. 4B is a perspective view of a guide and bearing member adapted to be received in a track formed in the drawer panel shown in FIG. 4A.
FIG. 4G is a perspective view of a front connector for use in connecting the drawer side panel to the drawer front.
FIG. 4H is a perspective view showing the internal construction of the front connector shown in FIG. 4G.
FIG. 4J shows a fitment for use in assisting closing of the drawer.
FIG. 5 is a fragmentary perspective view of a drawer and runner constructed from the components shown in FIGS. 4A to 4H.
FIG. 6 is a fragmentary perspective view of a drawer and runner constructed from the components shown in FIGS. 4A, 4D, 4E, 4G, 4H, 4K and 4L.

FIGS. 4 to 6 show modifications of the arrangements shown in FIGS. 1 to 3 and wherever possible similar parts are designated by similar reference numbers increased by 100. Referring to FIG. 4A a side panel is shown at 105, a corner piece at 103 and an end connector for connecting the drawer side to a suitable facia panel at 104. The drawer panel 105 comprises upper, intermediate and lower hollow sections 106A, 106B and 106C separated by internal webs 107. An inwardly directed recess 108 is formed in the hollow section 106C adjacent the lower longitudinal edge of the panel to accommodate an edge of a drawer bottom (not shown). The lower hollow section 106C of the panel also incorporates a longitudinal channel 109 the entrance to which is narrower than the channel itself and comprises a slot 110 defined between upper and lower longitudinal lips 111A, 111B extending across the channel 109 towards one another so as to partially close same. The channel 109 constitutes an integral runner track designed to accommodate a guide and bearing member.

One form of guide and bearing member 114 which may be accommodated in the channel 109 is shown in FIG. 4B and comprises a body portion 115 formed with a through track or slot 116 and surmounted by a pair of rotatable wheels or rollers 117. A curved leaf spring 118 is located in the bottom of the track 116 between inturned lips 118A. Pips 115A project from the faces of the body portion which engage the lips 111A, 111B of the track 109 to reduce frictional contact. Similar pips are provided on the underside of the body portion.

In use the guide and bearing member is located in the track 109 with the rollers 117 uppermost and the recess or slot 116 in alignment with the entrance slot 110 to the track 109. The roller assembly is retained in the track by the lips 111A, 111B and by the corner piece 103 and front connector 104 which are located in the ends of the drawer panel when the drawer is assembled.

It should be noted that the extents to which the lips 111A and 111B extend across the channel 109 differ slightly. This is designed to ensure that the guide and bearing member 114 cannot be inserted into the channel upside down.

Figure 4C:
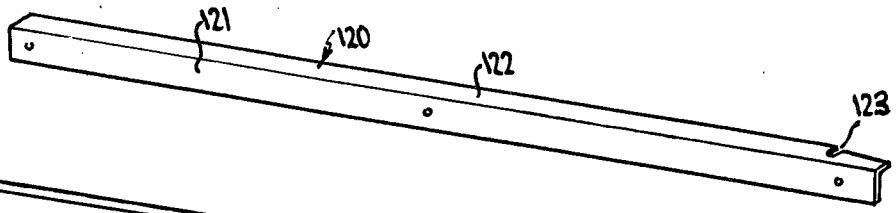
FIG. 4C shows one form of runner on which the drawer construction may be mounted.

The guide and bearing member 114 is adapted for engagement with a drawer runner 120 shown in FIG. 4C which is of angle form and L-shaped cross-section having a securing flange 121 by means of which the runner may be mounted in a suitable position in a cabinet or like housing in which the drawer is to be slidably located. The runner also has a drawer-engaging flange 122 which projects at right angles from the securing flange and is adapted to extent into the channel 109 for locking engagement with the guide and bearing member. For this purpose a notch 123 is formed adjacent the forward end of the drawer-engaging flange 122 and is adapted to engage with the guide and bearing member to retain same in a fixed position on the runner 120. A downwardly directed projection 125 is formed on the upper surface of the slot 116 in the guide and bearing member and engages with a notch 123 in the runner 120, engagement being maintained by virtue of the spring 118 urging the guide and bearing member downwardly and thereby retaining the projection 125 in the notch. A similar arrangement is of course provided at the other side of the drawer.

Figure 4K:
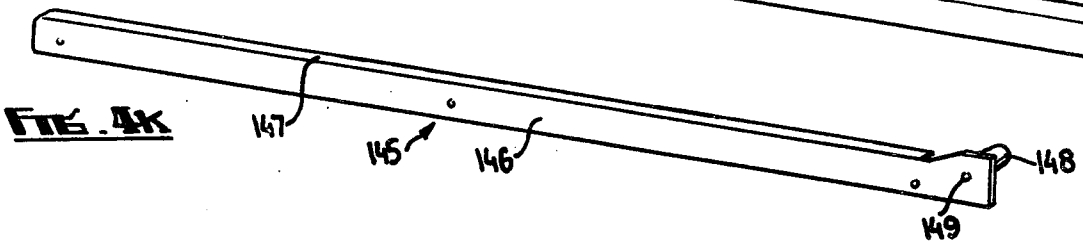
FIG. 4K is a perspective view of an alternative form of runner on which the drawer may be mounted.
Figure 4L:
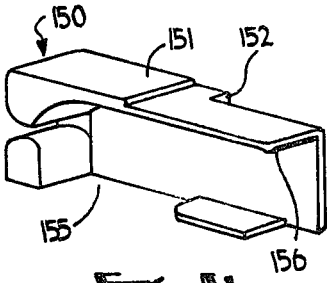
FIG. 4L is a perspective view of an alternative fitment for use in association with the corner connector shown in FIGS. 4D and 4E and the runner shown in FIG. 4K.
Figure 4D:
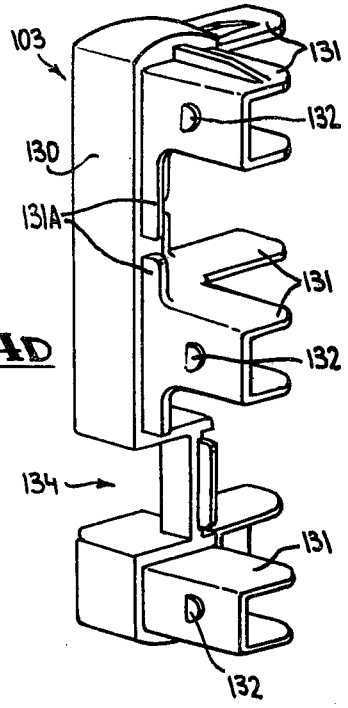
FIG. 4D shows a corner connector for use in connecting the drawer back and side panels.
Figure 4F:
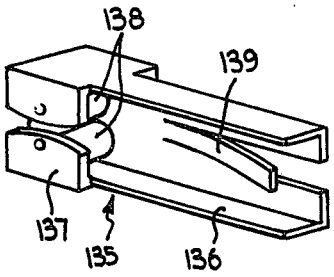
FIG. 4F is a perspective view showing one form of removable fitment used in association with the corner connector shown in FIGS. 4D and 4E and the runner shown in FIG. 4C.
Figure 4E:
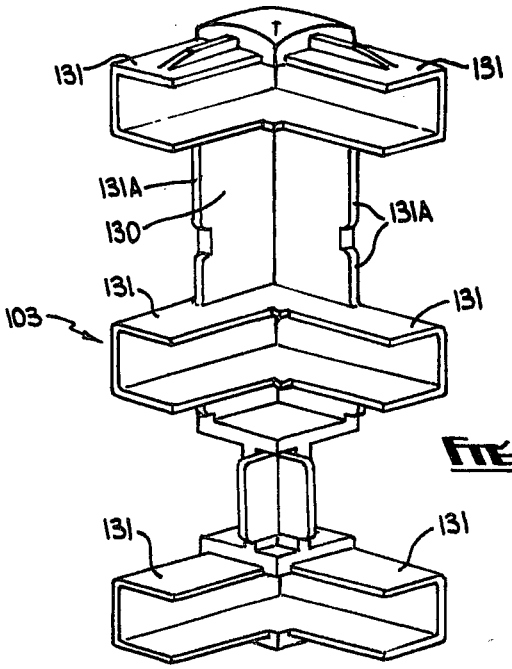
FIG. 4E is a perspective view showing the internal construction of the corner connector shown in FIG. 4D.

The corner pieces 103 (FIG. 4D) each comprise an upstanding corner post 130 having spigot members 131 projecting therefrom at right angles and spaced and dimensioned so as to form a tight push fit in the upper, intermediate and lower cavities of the associated wall panels. Detents 132 are provided on the projections 131 and engage in holes 133 formed in the outer face of the wall panel adjacent to the end thereof. Towards its lower end the post 130 is provided with a through opening 134 for accomodation of an insert 135 which cooperates with the runner 120 in use.

The insert 135 comprises a locking part 136 and a bearing or body part 137. The insert is located in the opening 134 in the corner post 130 after the drawer has been assembled and the locking part 136 extends beyond the corner post into the channel 109. A detent (not shown) similar to the detent 132 is provided on the surface of the locking part 136 which locates against the back or inner wall of the channel 109 for engagement with a hole 138 provided therein. The body part 137 incorporates a pair of rollers 138 which are spaced apart sufficiently to accommodate the flange 122 of the runner 120 and provide opposed bearing surfaces therefor. The rollers could alternatively be replaced by fixed bearing surfaces of the kind incorporated in the alternative insert to be described hereafter. The body or bearing part 137 thus provides a guide and bearing member for supporting the rear end of the drawer during sliding movement.

When the insert is in position it closes the rear end of the channel 109 and prevents withdrawal of the front guide and bearing member 114. A spring tongue 139 is bent outwardly from the back wall of the locking part 136 of the insert and serves as a spring to reduce side movement. This accommodates differences in tolerance of the drawer components introduced during manufacture and can be used alone or in conjunction with a spring of the kind shown at 19 in FIG. 2.

It will be noted that the corner connectors serve a number of functions. Firstly they serve to interconnect the side and back wall panels at right angles to one another. Secondly they incorporate supporting and guiding means for the rear of the drawer during its movement along the runners. Thirdly they provide end stops serving to limit the extent to which the drawer can be drawn out of the cabinet.

Each of the front connecting members 104 (FIG. 4G) comprises a face plate 140 provided with spigot members 141, similar to the spigots or projections 131 formed on the corner connectors 103, and adapted for engagement in the hollow end of the associated side wall panel. Prior to insertion of the front connectors into the respective wall panels the front connectors are secured to a suitable facia panel by screws passed through holes 142 in the face plates 140, whereupon the assembly comprising the facia panel and the two front connectors is engaged with the open forward ends of the side wall panels, the drawer bottom having been inserted in the meantime.

A raised rim 140A is provided round the peripheral edge of the face plate 140. This provides a slight clearance between the surface of the face plate and the surface of the drawer front to which it is attached so that the face plate contacts the drawer front at all points on its periphery despite any slight surface irregularities on the drawer front. The clearance provided at the central region of the face plate also accommodates material displaced from the drawer front in the region of the screw holes when the front connecting member is secured in position.

It should be noted that the detents provided on the corner and facia connectors and on the corner connector inserts are of D-shape and slope upwardly from their narrow to their wider ends. This is advantageous in providing a gradual increase in resistance both due to the increasing dimension of the D-form from the point towards the base and due to the sloping formation. Detents of this form do not present undue resistance to interconnection of the components but at the same time provide a secure connection when engaged.

The construction of the corner pieces 103 and front connecting members 104 is such that they cannot be wrongly inserted in the ends of the wall panels. For this purpose flange-like extensions 131A are provided on the upper and central spigot members of the corner pieces 103 and similar extensions 141A are provided on the central spigot member of the front connecting member. These extensions interfere with the internal webs 107 of the wall panels if the corner pieces or front connecting members are offered to the wall panels in an inverted or reversed position. Incorrect assembly is also prevented in some cases by interference between the spigot members and the recesses 108 in the panels.

In use, the drawer is supplied to the customer in disassembled or knocked-down condition and is erected by inserting the corner pieces 103 in the open ends of the side and back wall panels thereby joining same together at right angles to one another. The inserts 136 are then fitted and thereafter the guide and bearing members 114 may be inserted in the respective tracks or channels 109 in the side walls and the drawer bottom engaged in the slots 108. The front connectors 104 are then secured to the facia panel in suitable positions corresponding to the spacing of the drawer sides and the assembly comprising the facia panel and the front connectors is then engaged with the remainder of the drawer by pushing the spigots on the front connectors into the hollow ends of the side wall panels. The guide and bearing members 114 are then trapped within the tracks 109 at opposite sides of the drawer but are free to slide longitudinally therealong. The assembled construction is shown in FIG. 5 of the drawings.

The drawer may then be inserted in the cabinet or the like in which it is to be housed and which is first of all provided with opposed runners of the kind shown at 120 in the drawings. The drawer may be engaged with the runners by simply pushing it into the opening in the cabinet to its fully closed position, in which position the projections 125 on the guide and bearing members reach the notches 123 in the respective runners. The guide and bearing members then lock on to the associated runners and are retained in position, the drawer being free to slide along the runners between the limits defined by engagement of the guide and bearing members with the inserts 135 and the front mouldings which are disposed at opposite ends of the tracks 109. If it is desired to release the drawer from the cabinet the springs 118 are depressed by lifting the front of the drawer, thereby enabling the guide and bearing members to be disengaged from the slots 123 whereupon the drawer can be drawn completely out of the cabinet.

The drawer is constructed to enable it to be modified for use in association with an alternative form of runner. The modified runner is shown at 145 in FIG. 4K and has a vertical or mounting flange 146 enabling it to be attached to a drawer cabinet or the like in a suitable position, and a horizontal or drawer-engaging flange 147 which in use extends into the track 109 through the entrance slot 110. At its forward end the vertical flange 146 is extended and and carries a roller 148 rotatable about a horizontal pin 149. A modified insert 150 is used in association with the runner 145 and is generally similar to that shown at 135 but has an extended body portion 151 terminating in a shoulder 152 which abuts the corner piece and limits the extent to which the insert can be pushed into the opening 134 in the corner piece 130. The locking portion is provided with a detent (not shown) which engages with the hole 138 in the rear wall of the channel 109, but when the insert is in position the body portion projects to the rear of the drawer leaving a downwardly directed opening 155 forming an entrance to the channel 109. In this way the drawer may be mounted on the runners by engaging the rollers 148 with the openings 155 and pushing the drawer into the cabinet so that the rollers travel along the channels 109 at opposite sides of the drawer.

A downwardly projecting lip 156 is provided at the forward end of each insert 150. This is engaged by the roller 148 when the drawer is opened and acts as a stop to prevent complete removal of the drawer from the cabinet. If required the drawer may be completely removed by lifting it slightly to enable the rollers 148 at each side to clear the lips 156 on the respective inserts 150, following which the drawer can bw drawn forward until the rollers are located above the openings 155, enabling the drawer to be lifted clear and withdrawn from the cabinet.

In order to provide a self-closing effect a metal clip 160 locates over the horizontal web separating the hollow sections 106B and 106C of the panel at one or both sides of the drawer. The clip is provided with a slightly domed region 161 which, by interaction with the associated roller, urges the drawer towards its closed position.

It will be appreciated that the drawer assembly may be utilised in association with either of the runner arrangements described without requiring any modification of the drawer itself other than the substitution of the revised corner connector fitment and the use of the alternative runner. The same wall panels, front and corner connectors are used in both cases and the drawers themselves are completely interchangeable as between one system and the other.

Various modifications may be made without departing from the invention. For example the construction of the guide and bearing member may be altered and it could incorporate a fixed bearing surface of curved or other form instead of rollers. If desired a plurality of such guide and bearing members could be provided at spaced intervals along the associated runner; in this event it may be possible to dispense with the rear guide and bearing members. The drawer panels may also be of different construction provided they incorporate integral tracks for engagement with the drawer runners. The track is preferably contained within the dimensions of the wall panel itself but could in some instances be fitted to the outer surface thereof. Moreover while in the arrangements described the connecting pieces are held in engagement with the panels by projecting detents engaging in holes in the panels, alternative means of securing the connecting pieces may be used; for example they could be secured in place by adhesive. Moreover though particularly beneficial when used in association with hollow extruded plastics drawer constructions in knock-down form, the invention is also applicable to other forms of drawer.

It should be appreciated that a number of the features described above may be used independently of the others in drawers or drawer components of different construction and such features constitute separate inventions in their own right.

We claim:

1. A drawer assembly comprising a drawer having tracks formed in the sides thereof adapted to receive any one of a plurality of interchangeable drawer runners of different form and a plurality of alternatively useable guide and bearing members adapted to slidingly support and guide the rear end of the drawer on the respective forms of runner, wherein one form of runner is of angle section having a mounting flange by means of which the runner may be mounted at a suitable location in a drawer supporting structure and a drawer-engaging flange projecting at right angles to the mounting flange and adapted to extend into the track in the associated drawer side, a front guide and bearing member being detachably mounted at the forward end of the runner for sliding movement longitudinally of said track and said rear guide and bearing member being disposed in vertical alignment with the associated rear corner of the drawer and having a slot dimensioned to slidingly receive said drawer-engaging flange of the runner.

2. A drawer assembly comprising a drawer having tracks formed in the sides thereof adapted to receive any one of a plurality of interchangeable drawer runners of different form and a plurality of alternatively useable guide and bearing members adapted to slidingly support and guide the rear end of the drawer on the respective forms of runner wherein said rear guide and bearing members comprise inserts adapted to be removably mounted at the rear end of each of said tracks and wherein said inserts are adapted to be located in position by locking means engageable with complementary locking means on the drawer.

3. A drawer assembly according to claim 2 wherein said inserts are adapted to be located in position by engagement with retaining means on a connecting member interconnecting the drawer back and side.

4. A drawer assembly according to claim 2 wherein said inserts are adapted to be located in position by locking means engageable with complementary locking means on an associated drawer panel.

5. A drawer according to claim 4 wherein each of said inserts is engaged with the associated wall panel by means of a detent on a forward portion of the insert engaging in an aperture in the rear wall of the track in the associated wall panel.

6. A drawer assembly comprising a drawer having integral tracks formed in the sides thereof, a pair of drawer runners adapted for engagement with said tracks and dimensioned so as to leave a clearance above and below same when located in the tracks, a front guide and bearing member interposed between each runner and the associated track at the forward end of the runner and a rear guide and bearing member incorporated in each rear corner of the drawer to guide and support the rear end of the drawer on the respective runner, wherein said front guide and bearing member comprises a body member adapted for sliding engagement in the track formed in the associated drawer side, bearing means mounted on said body member so as to project from the upper surface thereof and locking means incorporated in said body member for locking engagement with a drawer runner.

7. A drawer according to claim 6 wherein said locking means is operable to lock on to a drawer runner automatically on engagement between the runner and the guide and bearing member.

8. A drawer having a pair of tracks formed one in each of the sides thereof, a front guide and bearing member retained in each of said tracks for movement therealong, a rear guide and bearing member at the rear of each of said tracks, and locking means on said front guide and bearing member operable for automatic locking engagement with a drawer runner on insertion of same into said track.

9. A drawer according to claim 8 wherein each of said front guide and bearing members is retained in the associated track by longitudinally extending lips projecting across the entrance to the track from the opposite longitudinal edges thereof.

10. A drawer according to claim 9 wherein said lips project across the entrance to said track by different extents.

11. A drawer according to claim 8 wherein a slot is formed in the face of the drawer side opposite to that in which said track is formed, the slot being adapted in use to receive an edge of a drawer bottom.

12. A drawer according to claim 8 in which the sides and back are constructed from panels of hollow extruded plastics construction having open ends and provided with apertures adjacent their opposite ends, connecting members being provided which have projecting spigot portions for engagement in the hollow ends of the panels, the spigot portions carrying detents for engagement with said apertures in the panels to attach the panels to one another.

13. A drawer according to claim 12 wherein each of said rear guide and bearing members is incorporated in one of said connecting members and comprises an opening in said connecting member which slidably receives the respective runner whereby to guide and support the rear end of the drawer during opening and closing movements thereof.

14. A drawer according to claim 8 wherein said front guide and bearing member comprises a body member adapted for sliding engagement in the associated track and bearing means projecting upwardly from said body member.

15. A drawer according to claim 14 wherein said bearing means comprises a pair of rollers mounted on spaced parallel axes.

16. A drawer according to claim 14 wherein said bearing means comprises a fixed bearing surface.

17. A drawer according to claim 14 wherein projecting pips are provided on at least one surface of said body member to reduce frictional resistance arising from contact of said surface of the body member with an adjacent surface of said track when the guide and bearing member is mounted in the track.

18. A drawer according to claim 8 wherein said rear guide and bearing members comprise removable inserts mounted at the rear ends of said tracks.

19. A drawer according to claim 8 wherein said locking means comprises an outwardly opening slot adapted to receive a flange on said drawer runner, one wall of said slot being resilient and the opposite wall being provided with a locking projection extending into the slot for engagement with a notch formed adjacent the forward end of said flange of the drawer runner to lock the guide and bearing member in position on the runner.

20. A drawer assembly according to claim 8 wherein each of said rear guide and bearing members comprise opposed fixed bearing surfaces.

21. A drawer assembly according to claim 8 wherein each of said rear guide and bearing members comprise opposed roller members.

* * * * *